US008302612B2

(12) United States Patent
Kominami

(10) Patent No.: US 8,302,612 B2
(45) Date of Patent: Nov. 6, 2012

(54) LOW IGNITION PROPENSITY CIGARETTE PAPER

(75) Inventor: Takashi Kominami, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 12/687,480

(22) Filed: Jan. 14, 2010

(65) Prior Publication Data

US 2010/0116282 A1 May 13, 2010

Related U.S. Application Data

(63) Continuation of application No. PCT/JP2008/063772, filed on Jul. 31, 2008.

(30) Foreign Application Priority Data

Aug. 10, 2007 (JP) ..... 2007-209036

(51) Int. Cl.
*A24D 1/02* (2006.01)

(52) U.S. Cl. ..... 131/365; 162/139

(58) Field of Classification Search ..... 131/365; 162/139

See application file for complete search history.

(56) References Cited

U.S. PATENT DOCUMENTS

| | | | | |
|---|---|---|---|---|
| 3,359,148 | A * | 12/1967 | Fukui | 156/180 |
| 5,439,010 | A * | 8/1995 | Ross | 131/332 |
| 6,221,952 | B1 * | 4/2001 | Nakamae | 524/503 |
| 6,929,013 | B2 * | 8/2005 | Ashcraft et al. | 131/365 |
| 2003/0136420 | A1 | 7/2003 | Kraker | |
| 2003/0150466 | A1 | 8/2003 | Kitao et al. | |
| 2004/0221861 | A1 | 11/2004 | Eibl | |
| 2008/0011312 | A1 | 1/2008 | Matsufuji et al. | |

FOREIGN PATENT DOCUMENTS

| | | | |
|---|---|---|---|
| CN | 1612700 | A | 5/2005 |
| EP | 1321048 | A1 | 6/2003 |
| EP | 2 127 545 | A2 | 12/2009 |
| JP | 6-319512 | A | 11/1994 |
| JP | 2004-512849 | A | 4/2004 |
| JP | 2005-506079 | A | 3/2005 |
| JP | 2005-514939 | A | 5/2005 |
| WO | WO-02/17737 | A1 | 3/2002 |
| WO | WO 03/061410 | A1 | 7/2003 |
| WO | WO-2006/098153 | A1 | 9/2006 |

OTHER PUBLICATIONS

Office Action for Chinese Application No. 200880008942.7 dated Oct. 8, 2010.

Taiwanese Office Action, dated Jan. 26, 2011, for Taiwanese Application No. 097129777.

International Preliminary Report on Patentability for Application No. PCT/JP2008/063772, dated Mar. 18, 2010.

Canadian Office Action for Application No. 2,693,075 dated Jun. 27, 2011.

Japanese Office Action for Application No. 2009-528076, mailed on Nov. 29, 2011.

* cited by examiner

*Primary Examiner* — Richard Crispino
*Assistant Examiner* — Dionne Walls Mayes
(74) *Attorney, Agent, or Firm* — Birch, Stewart, Kolasch & Birch, LLP

(57) ABSTRACT

A cigarette paper of the present invention includes a base cigarette paper and a plurality of combustion-suppressing regions provided, spaced apart from each other, on one surface of the base cigarette paper, the combustion-suppressing regions being formed by applying a polyvinyl alcohol having a degree of polymerization of 900 or more, or a polyvinyl alcohol whose 3% by weight aqueous solution exhibits a viscosity of 5 to 30 mPa·s as measured at 20° C.

4 Claims, 1 Drawing Sheet

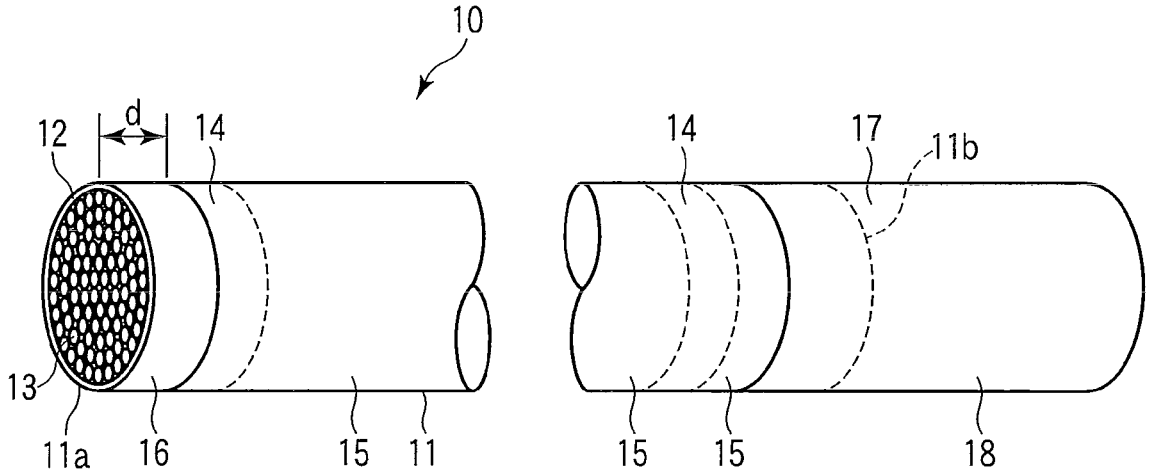
10
12
d
14
13
11a
16
15
11
14
17
11b
15
15
18

LOW IGNITION PROPENSITY CIGARETTE PAPER

CROSS-REFERENCE TO RELATED APPLICATIONS

This is a Continuation Application of PCT Application No. PCT/JP2008/063772, filed Jul. 31, 2008, which was published under PCT Article 21(2) in Japanese.

This application is based upon and claims the benefit of priority from prior Japanese Patent Application No. 2007-209036, filed Aug. 10, 2007, the entire contents of which are incorporated herein by reference.

BACKGROUND OF THE INVENTION

1. Field of the Invention

The present invention relates to a low ignition propensity cigarette paper.

2. Description of the Related Art

There is proposed a cigarette paper coated with a film-forming composition in a band form to lower air permeability of the coated portions so as to retard the outbreak of fire from a cigarette even if a smoker drops the cigarette through, for example, carelessness on the floor or the like (Jpn. PCT National Publication No. 2004-512849). As the film-forming composition, there are exemplified alginates, pectin, silicates, carboxymethylcellulose, other cellulose derivatives, guar gum, starch, modified starch, polyvinyl acetate and polyvinyl alcohols.

However, the cigarette paper coated with the film-forming composition is not measured for the actual ignition propensity in Jpn. PCT National Publication No. 2004-512849.

BRIEF SUMMARY OF THE INVENTION

Among various substances, the present inventors have studied polyvinyl alcohols with respect to their effects on the actual ignition propensity of the cigarette paper to find that the coating amount required to achieve the same level of ignition propensity varies depending on the degree of polymerization or viscosity of polyvinyl alcohols.

Thus, it is an object of the present invention to provide a cigarette paper which exhibits a markedly low ignition propensity at a relatively small coating amount.

To achieve the above-described object, according to a first aspect of the present invention, there is provided a low ignition propensity cigarette paper comprising a base cigarette paper and a plurality of combustion-suppressing regions provided, spaced apart from each other, on one surface of the base cigarette paper, characterized in that the combustion-suppressing regions is formed by coating a polyvinyl alcohol having a degree of polymerization of 900 or more.

According to a second aspect of the present invention, there is provided a low ignition propensity cigarette paper comprising a base cigarette paper and a plurality of combustion-suppressing regions provided, spaced apart from each other, on one surface of the base cigarette paper, characterized in that the combustion-suppressing regions is formed by coating a polyvinyl alcohol whose 3% by weight aqueous solution exhibits a viscosity of 5 to 30 mPa·s as measured at 20° C., and the cigarette paper provides a cigarette exhibits a PFLB value of 0 to 5% as determined in accordance with ASTM E-2187-04.

BRIEF DESCRIPTION OF THE SEVERAL VIEWS OF THE DRAWING

The single FIGURE is a partially cutaway schematic perspective view of a cigarette wrapped by a cigarette paper according to one embodiment of the present invention.

DETAILED DESCRIPTION OF THE INVENTION

The present invention will be described below in more detail.

The cigarette paper of the present invention is a cigarette paper providing a base (base cigarette paper), on which a plurality of combustion-suppressing regions are provided, spaced apart from each other, by coating a combustion-suppressing agent composed of a polyvinyl alcohol having a specified degree of polymerization or viscosity.

The base cigarette paper is an ordinary cigarette paper based on an ordinary pulp such as a flax pulp. Such a base cigarette paper may contain a generally used filler such as a carbonate salt, e.g., calcium carbonate or potassium carbonate, or a hydroxide, e.g., calcium hydroxide or magnesium hydroxide, in a amount of 2 g/m$^2$ or more. The filler may be contained in the base cigarette paper in an amount of 2 to 8 g/m$^2$. The base cigarette paper usually has a basis weight of 15 to 30 g/m$^2$. The basis weight is preferably 20 to 28 g/m$^2$. The intrinsic air permeability of the base cigarette paper is usually 30 to 60 CORESTA units.

A burn-adjusting agent such as citric acid or its salt (a sodium or potassium salt) may be added to the base cigarette paper. The burn-adjusting agent, if added, is used usually in an amount of 2% by weight or less in the base cigarette paper.

On one surface of the base cigarette paper, a plurality of combustion-suppressing regions are provided, spaced from each other, each being formed by coating a combustion-suppressing agent (polyvinyl alcohol). When a tobacco rod is wrapped by the cigarette paper, the combustion-suppressing regions may be provided in the form of stripes extending in the longitudinal direction of the tobacco rod and being spaced apart from each other in the circumferential direction of the tobacco rod. Alternatively, the combustion-suppressing regions may be provided in the form of round annular bands extending in the circumferential direction of the tobacco rod and being spaced from each other in the longitudinal direction of the tobacco rod.

In the present invention, a polyvinyl alcohol is used as the combustion-suppressing agent. In one embodiment of the present invention, a polyvinyl alcohol having a degree of polymerization (the number of monomers) of 900 or more is used. It is preferable that the degree of polymerization of the polyvinyl alcohol used be 3000 to 4000. In another embodiment of the present invention, use is made of a polyvinyl alcohol whose 3%-by-weight aqueous solution exhibits a viscosity of 5 to 30 mPa·s measured at 20° C. It is preferable that the viscosity of the polyvinyl alcohol be 20 to 30 mPa·s.

The degree of polymerization and viscosity of the polyvinyl alcohol correlate with each other to some degree. By using the polyvinyl alcohol having such a high degree of polymerization or viscosity, the same level of low ignition propensity can be achieved with a smaller coating amount compared to the case where the other polyvinyl alcohol is used.

The cigarette paper of the present invention, with the above-described polyvinyl alcohol coated thereon, can provide a cigarette (cigarette composed of a tobacco filler wrapped with the cigarette paper) which exhibits a PFLB (percent full-length burn) value of 0 to 5% as determined in accordance with ASTM E-2187-04. Generally, the coating amount (dry basis) of the polyvinyl alcohol combustion-suppressing agent is preferably less than 3 g per $m^2$ of coated area. The coating amount of 0.2 to 2 g/$m^2$ can achieve sufficiently low ignition propensity.

The low ignition propensity cigarette paper of the present invention wraps a tobacco rod composed of a tobacco filler such as cut tobacco leaves. Usually, the surface coated with the combustion-suppressing agent is brought into contact with the tobacco rod.

FIGURE shows a cigarette wrapped by a cigarette paper coated with the combustion-suppressing agent in the form of round annular bands.

Referring to FIGURE, a cigarette 10 has a tobacco rod 11 composed of a tobacco filler 13 wrapped by a base cigarette paper 12, in the form of a column. The tobacco rod 11 usually has a perimeter of 17 to 26 mm and a length of 49 to 90 mm. An ordinary filter 18 may be attached to the proximal end (i.e., the downstream end with respect to the direction of suction) 11*b* of the tobacco rod 11 by means of a tip paper 17 by the ordinary procedure.

A plurality of round annular band regions 14 coated with the combustion-suppressing agent (polyvinyl alcohol) are formed on the base cigarette paper 12, and define combustion-suppressing regions. These round annular band-shaped combustion-suppressing regions 14 are spaced apart from each other in the longitudinal direction of the tobacco rod.

Normal combustion regions 15 not coated with the burn-adjusting agent are defined between adjacent round annular band-shaped combustion-suppressing regions 14. Since these regions 15 are portions of the base cigarette paper 12, they burn in the same manner as the base cigarette paper 12 under the ordinary smoking conditions. Accordingly, the regions 15 serve as normal combustion regions. For example, two or three round annular band-shaped combustion-suppressing regions 14 may be formed. The round annular band-shaped combustion-suppressing regions 14 may have a width, in the longitudinal direction, of 4 to 7 mm, and their thickness may usually be 0.1 to 5 μm. The distance between adjacent combustion-suppressing regions 14 is preferably 18 to 25 mm.

In the cigarette shown in FIGURE, a region 16 extending from its tip to a distance d is not coated with the combustion-suppressing agent. The tip region uncoated with the combustion-suppressing agent also composes a normal combustion region 16, which may correspond to the region of an ordinary cigarette to be burned in one or two puffs. The distance d may be 10 to 25 mm from the tip 11*a* of the tobacco rod. It is not necessary to form the combustion-suppressing regions 14 on an inner surface of the cigarette paper that corresponds to that region of the cigarette paper 12 which is covered by the tip paper 17.

When the cigarette 10 is lit at the tip 11*a* of the tobacco rod 11 and suctioned to burn the cigarette, the normal combustion regions 15 burn in the same manner as ordinary cigarettes, and the flavor can be tasted. However, if the burning cigarette 10 is placed on a combustible material such as a carpet, a tatami mat, a wood product, a fabric or a cloth, the combustion-suppressing regions 14 present in the direction in which combustion proceeds cooperate with the heat absorption by the combustible material, extinguishing the cigarette 10, whereby outbreak of fire from the combustible material is prevented.

Examples of the present invention will be described below, but the present invention is not limited to these Examples.

Examples 1 to 4 and Comparative Examples 1 to 4

Table 1 shows the degree of polymerization, viscosity and degree of saponification of polyvinyl alcohols used in the Examples and Comparative Examples. All of the polyvinyl alcohols used are manufactured by Wako Pure Chemical Industries, Ltd.

The viscosity shown in Table 1 was a result of measurement in which 200 g of a 3% by weight aqueous solution of polyvinyl alcohol was placed in a 200- or 300-mL beaker, this beaker was placed in a constant temperature bath, and the aqueous solution was gently stirred for about one minute with a glass rod so as not to allow air bubbles to mix in, while keeping the temperature of the aqueous solution at 20±0.5° C. Thereafter, the solution was allowed to stand for 10 minutes, and the viscosity was measured using a B-type viscometer.

TABLE 1

| Designation symbol of polyvinyl alcohol | Polymerization degree of polyvinyl alcohol (Number of monomers) | Viscosity (mPa · s) | Saponification degree (mol %) |
|---|---|---|---|
| P500 | 400-600 | 3.9 | 86.0-90.0 |
| P1000 | 900-1100 | 5.3 | 86.0-90.0 |
| P3500 | 3100-3900 | 28.4 | 86.0-90.0 |

Then, a 3% by weight aqueous solution of a combustion-suppressing agent (polyvinyl alcohol) was coated (printed) by a direct gravure process onto a base cigarette paper (width: 27 mm; length: 1.500 m; filler: calcium carbonate, burn-adjusting agent: sodium citrate) having the specification shown in Table 2, in the form of stripes with a constant width of 7 mm at a constant distance of 20 mm in the longitudinal direction, thereby forming 56 combustion-suppressing agent-coated regions. The cigarette paper thus obtained was measured for the total coating amount of polyvinyl alcohol by the following procedure. The results are also listed in Table 2.

<Measurement of Total Coating Amount of Polyvinyl Alcohol>

This measurement is based on the fact that a polyvinyl alcohol forms a colloid compound with boric acid, and this boric acid-polyvinyl alcohol colloid shows a blue color.

The combustion-suppressing agent-coated cigarette paper (width 27 mm, length 1.500 m) (about 1.0 g) was cut into 1 mm square pieces, 100 mL of distilled water was added to the pieces, and extraction was effected sufficiently in a constant temperature bath at 70° C. To 5 mL of the extract liquid, 15 mL of a previously prepared 4% by weight boric acid aqueous solution was added, and the mixture was stirred. Thereafter, 3 mL of an iodine aqueous solution was added, and water was added to the mixed solution to make 50 mL, thus providing a test solution. The test solution was measured for the absorbance at 690 nm using an ultraviolet-visible absorptiometer with a peak wavelength set at 690 nm. The absorbance thus measured was converted to a concentration using a previously prepared absorbance-concentration calibration curve, giving the total coating amount in the cigarette paper.

TABLE 2

| Ex. | Base cigarette paper: Amount of filler ($g/m^2$) | Basis weight ($g/m^2$) | Amount of burn-adjusting agent (% by weight) | Air permeability (C.U.) | Combustion-suppressing agent | Amount of combustion-suppressing agent ($g/m^2$) |
|---|---|---|---|---|---|---|
| Comp. Ex. 1 | 7.7 | 25.0 | 0.6 | 30.0 | None | 0 |
| Comp. Ex. 2 | 5.2 | 21.2 | 0.1 | 71.9 | None | 0 |
| Comp. Ex. 3 | 7.7 | 25.0 | 0.6 | 30.0 | P500 | 2.7 |
| Comp. Ex. 4 | 5.2 | 21.2 | 0.1 | 71.9 | P500 | 1.7 |
| Ex. 1 | 7.7 | 25.0 | 0.6 | 30.0 | P1000 | 2.7 |
| Ex. 2 | 5.2 | 21.2 | 0.1 | 71.9 | P1000 | 1.6 |
| Ex. 3 | 7.7 | 25.5 | 0.6 | 30.0 | P3500 | 1.4 |
| Ex. 4 | 5.2 | 21.2 | 0.1 | 71.9 | P3500 | 1.0 |

As shown in Table 2, in the cigarette papers of Examples 1 to 4, the coating amount of the combustion-suppressing agent (polyvinyl alcohol) per square meter of area coated with the combustion-suppressing agent was 1.0 to 2.7 g. When the coating amount of the combustion-suppressing agent is converted to a value per unit area of the cigarette paper, the above value is multiplied by 7/27.

A tobacco rod composed of the American blend cut tobacco (tar content without filter: 19 to 20 mg) was wrapped with the cigarette paper obtained above, and the rod was cut such that the first coated region was arranged at a distance of 5 mm from the combustion tip of the cigarette. The length of one cigarette was 59 mm, and the number of combustion-suppressing agent-coated regions was two.

The cigarette thus obtained was subjected to ignition propensity test in accordance with ASTM E-2187-04, and the percentage full-length burn (PFLB) value was determined. Further, these cigarette samples were measured for the CO amount in the mainstream smoke, the number of puffs, and the tar amount per cigarette sample in accordance with the methods described below. In addition, from the measured CO and tar amounts, the CO/tar (C/T) ratio was calculated. The results are listed in Table 3.

<Measurement of CO Amount and Number of Puffs>

For the measurement of the CO amount, the tobacco smoke was collected using an eight-channel linear smoking machine (SM342) manufactured by FILTRONA. The cigarette sample was burned in keeping with ISO standards; the cigarette was smoked at a rate of 35 mL/2 seconds at intervals of 60 seconds, and the smoke passed through the glass fiber filter was collected in a gas bag. The smoking was stopped when the burned length reached the reference point (51 mm from the lit end of the cigarette (8 mm from the border between the cigarette paper and tip paper on the tip side)). The number of puffs was recorded to this point. After combustion, in order to collect the gas remaining in the cigarette sample, the burning tip was cut off, and then the cigarette sample was puffed three times in a non-burning state. In this manner, the gas from the cigarette sample was collected in the gas bag, and the total particulate matter (TPM) was collected on the glass fiber filter.

Using the filled gas bag, the CO amount per cigarette sample was measured using a CO measuring apparatus manufactured by Filtrona.

<Measurement of Tar Amount>

After determining the crude tar amount from the glass fiber filter which had collected the particulate components during the measurement of the CO amount noted above, the filter was placed in a serum bottle and vigorously shaken for 20 minutes together with 10 mL of 2-propanol (GC grade, manufactured by Wako Pure Chemical Industries, Ltd.). The extract liquid was filtered into a vial. The vial was placed on a gas chromatograph, and the water and nicotine amounts were measured. The assay was carried out using an internal reference method. The water and nicotine amounts were subtracted from the crude tar amount, and the difference was recorded as the tar content.

TABLE 3

| | PFLB value (%) | Number of puffs | Tar amount (mg) | CO amount (mg) | C/T ratio |
|---|---|---|---|---|---|
| Comp. Ex. 1 | 100 | 6.8 | 19.9 | 13.8 | 0.69 |
| Comp. Ex. 2 | 81-95 | 7.2 | 20.0 | 12.7 | 0.64 |
| Comp. Ex. 3 | 40-60 | 6.8 | 20.7 | 15.2 | 0.73 |
| Comp. Ex. 4 | 40-60 | 7.4 | 22.2 | 14.2 | 0.64 |
| Ex. 1 | 0-5 | 7.2 | 21.3 | 15.4 | 0.72 |
| Ex. 2 | 0-5 | 7.6 | 23.6 | 14.6 | 0.62 |
| Ex. 3 | 0-5 | 6.9 | 22.7 | 15.9 | 0.70 |
| Ex. 4 | 0-5 | 7.4 | 22.7 | 14.7 | 0.65 |

As can be seen from the results of Comparative Examples 3 and 4, when the polyvinyl alcohol P500 is used, the PFLB is lowered compared to Comparative Examples 1 and 2, but can not achieve a PFLB value of 0 to 5% even when the coating amount is increased to 2.7 $g/m^2$. On the other hand, each of Examples 1-4, in which the polyvinyl alcohols P1000 and P3500 are used, can achieve a PFLB value of 0 to 5%. Further, as can be seen from the results of Comparative Example 3 and Example 1, and Comparative Example 4 and Example 2, the PFLB values of the former two are 40 to 60%, while the PFLB values of the latter two are 0 to 5%, at the same coating amount, suggesting that the present invention requires a smaller coating amount to achieve a PFLB value of 0 to 5%. Further, as can be seen from the results of Examples 1 to 4, the polyvinyl alcohol P3500 requires a smaller coating amount than the polyvinyl alcohol P1000 in order to achieve a PFLB value of 0 to 5%.

What is claimed is:

1. A low ignition propensity cigarette paper comprising a base cigarette paper and a plurality of combustion-suppressing regions provided, spaced apart from each other, on one surface of the base cigarette paper, wherein the combustion-suppressing regions are formed by coating, in an amount totaling less than 3 $g/m^2$, a polyvinyl alcohol having a degree of polymerization of 900 to 1100 or 3100 to 3900 and a saponification degree of 86.0 to 90.0 mol %.

2. The cigarette paper according to claim 1, wherein the base cigarette paper has a basis weight of 15 to 30 $g/m^2$.

3. The cigarette paper according to claim 1, wherein, when a tobacco rod is wrapped by the cigarette paper, the combustion-suppressing regions are in a form of stripes extending in a longitudinal direction of the tobacco rod and being spaced apart from each other in a circumferential direction of the tobacco rod.

4. The cigarette paper according to claim 1, wherein, when a tobacco rod is wrapped by the cigarette paper, the combustion-suppressing regions are in a form of round annular bands extending in a circumferential direction of the tobacco rod and being spaced from each other in a longitudinal direction of the tobacco rod.

* * * * *